United States Patent [19]

Spross et al.

[11] Patent Number: 4,846,607

[45] Date of Patent: Jul. 11, 1989

[54] DEVICE FOR THE GUIDING AND POSITIONING OF SUPPORT PLATES ON A DEMOLITION MACHINE FOR UNDERGROUND CONSTRUCTION

[75] Inventors: Erhard Spross, Neunkirch; Hans-Rudolf Ruttimann, Rafz; Gunter Straub, Schleitheim, all of Switzerland

[73] Assignee: SIG Schweizerische Industrie-Gesellschaft, Neuhausen am Rheinfall, Switzerland

[21] Appl. No.: 112,116

[22] Filed: Oct. 26, 1987

[30] Foreign Application Priority Data

Nov. 7, 1986 [CH] Switzerland ..... 4452/86

[51] Int. Cl.[4] ..... F21D 11/40

[52] U.S. Cl. ..... 405/303; 405/288

[58] Field of Search ..... 405/259, 282, 288, 290, 405/291, 303; 299/11, 33

[56] References Cited

U.S. PATENT DOCUMENTS 4,252,475 2/1981 Cobb et al. ..... 405/291

4,351,625 9/1982 Selestam et al. ..... 405/303

*Primary Examiner*—David H. Corbin

*Attorney, Agent, or Firm*—Lewis H. Eslinger; Jay H. Maioli

[57] ABSTRACT

Support plates used in so-called rock bolting for supporting the roof in an underground excavation, such as a tunnel or mine, are positioned initially by a parallelogram bar structure that is attached to a moveable shield that is moveable upwardly toward the roof by lifting cylinders. Two bar structures are arranged side-by-side and each has at one end a shoe that includes support plate positioning surfaces and at least one shoe has a centering pin that automatically locates and centers the support plate. Upon placing a support plate on the shoes and determining that the excavation roof is of a sufficient height, the two bar structures are pivotted upwardly, which turns the support plate parallel to the roof and by means of the lifting pistons the support plate is firmly pressed against the roof so that automatic anchor placement or rock bolting is facilitated.

16 Claims, 1 Drawing Sheet

DEVICE FOR THE GUIDING AND POSITIONING OF SUPPORT PLATES ON A DEMOLITION MACHINE FOR UNDERGROUND CONSTRUCTION

BACKGROUND OF THE INVENTION

1. Field of the Invention

This invention relates generally to an apparatus for use with the demolition machine for underground excavation and, more particularly, to apparatus for placing support plates against the roof of an underground excavation for subsequent use with rock bolts.

2. Description of the Background

When performing underground construction, such as tunnel building or mining, it is frequently required to support the overhead portion or roof of the tunnel. Although in the past timbering was one conventional approach to achieve roof supporting, recently a new technique known as rock bolting or roof bolting has become popular. In accordance with this technique bolts that are around ¾–1 inch in diameter and from 4–8 feet long are embedded in the tunnel roof to prevent cave-ins. Typically attached to one threaded end of the rock bolt is a bearing plate or support plate that is retained by a nut threaded to the rod.

The support plates generally are placed transversely relative to the width of the gallery or underground excavation and the plates anchored to the roof by the rock bolts that are installed by drilling holes through the plates and then placing the rock bolts or anchor rods through the plates into the roof. In the placement of these support plates, the operations known heretofore involved the positioning of the plate and pressing it to the overhead portion of the tunnel with pistons and then boring holes through holes in the plates into the roof or overhead portion of the underground excavation. Once the holes are bored in the roof then the rock bolts, in the form of threaded rods, are introduced and locked in the holes. In some cases the end of the bolt is first split then expanded by a wedge in the hole. The other end of the bolt or anchor is threaded and after the support plate is placed over the threaded end a nut is tightened thereon, thereby holding the support plate firmly in place. One other approach is to inject a resin into the hole to lock the rock bolt therein.

Among the several disadvantages that are inherent in the known approach to using support plates and rock bolts as described above are the great deal of time that is required to align the anchor rods and the holes in the roof and also to align a suitable device for introducing the synthetic resin into the holes so that the anchor rods may be firmly held in the roof. There is also an appreciable length of time required to align the anchor rods with the through holes formed in the support plate. Perhaps most important, however, is the disadvantage in the known procedure in that the roof is not yet supported during placement of the anchors and plates and, thus, working in the area where the rock bolts and support plates are being installed is highly dangerous.

OBJECTS AND SUMMARY OF THE INVENTION

Accordingly, it is an object of the present invention to provide apparatus for installing support plates in the roof of an underground excavation that can eliminate the above-noted defects inherent in the prior art.

Another object of this invention is to provide apparatus for installing support plates used with rock bolts in the overhead portion during underground construction in which the support plates are installed from a position that is beneath a location at which support plates and rock bolts have already been placed in position.

A further object of this invention is to provide apparatus for positioning support plates in the roof of an underground excavation, in which rotatable support arms are provided for swinging the support plate upward to the roof, in which the support arms have shoes at the operable ends thereof that automatically align the support plate against the roof for proper placement.

In accordance with an aspect of the present invention, apparatus for feeding and positioning support plates for use in rock bolting with a demolition machine in underground construction includes at least two arms that rotate or swing about respective horizontal shafts, with each arm carrying a shoe at least one of which includes an automatic centering pin for centering the support plate transversely on the heads and all of which include specially angled surfaces for centering the support plate in its longitudinal direction. The shoes are pivotally fixed to the swing arms that are movable in the upward direction toward the overhead and upon swinging the arms, the heads are automatically rotated by means of a parallel bar construction to position the support plate against the roof of the tunnel.

The above and other objects, features, and advantages of the present invention will become apparent from the following detailed description of illustrative embodiments thereof to be read in conjunction with the accompanying drawings.

DETAILED DESCRIPTION OF THE PREFERRED EMBODIMENT

Figure 1:
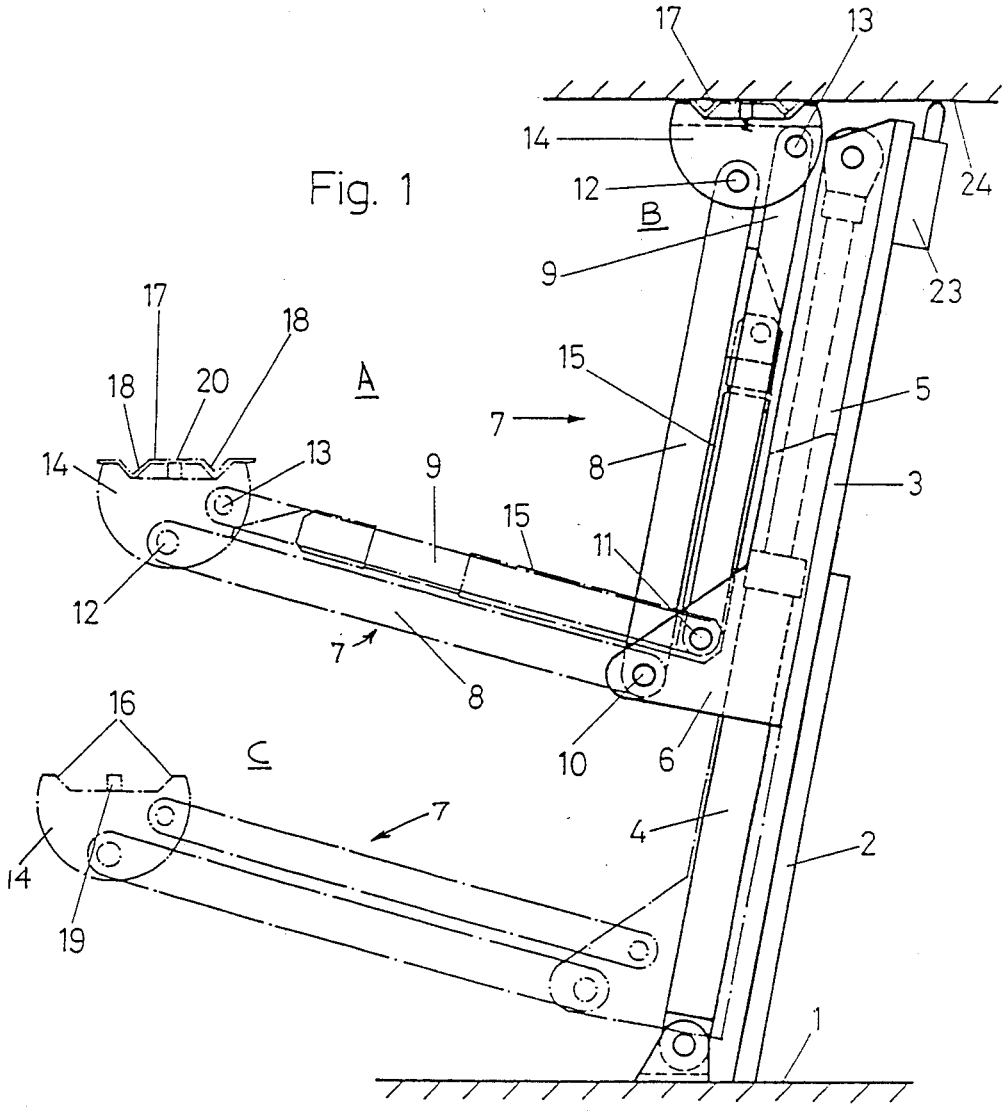
FIG. 1 is an elevational view of support plate positioning apparatus according to an embodiment of the present invention and showing three separate stages of operation of that apparatus.

The present invention is intended for use with a so-called demolition or excavation machine used for underground construction or mining and, in that regard, the inventive apparatus is shown in FIG. 1 mounted on a platform 1 of such a demolition machine. The location of the inventive apparatus on the demolition machine is at the front and immediately behind the actual demolition tools. A fixed shield 2 is provided that generally abuts platform 1 of the demolition machine and mounted on the fixed shield 2 is a moveable shield 3 that can be moved upwardly toward the roof by actuation of two pistons 4, only one of which is shown in FIG. 1. It should be understood that in the elevational view of FIG. 1 only the nearer of the two cylinders or pistons is seen and another piston is spaced apart behind the one shown in FIG. 1. Moveable shield 3 that moves along fixed shield 2 includes reinforcement plates 5 welded to the moveable shield 3 on both sides of each of the two lifting cylinders 4.

At the lower ends of reinforcement plates 5 are arranged triangularly-shaped carrier plates 6 that provide attachment for two swivel arms 7. Again, it should be noted that only the nearer of the two swivel arms is shown in FIG. 1. Furthermore, FIG. 1 includes three different actuation positions, A, B, and C, of the swivel arms 7. Each swivel arm 7 consists of two parallel bars 8, 9 that are articulated by means of bearings 10, 11, respectively, on the carrier plates 6. Parallel bars 8, 9 are connected at ends opposite carrier plates 6 to a shoe 14 by rotary bearings 12 and 13, respectively. Thus, carrier 6, bars 8, 9, and shoe 14 form a parallelogram bar structure that may be swung about pivots or bearings 10, 11 by means of a rotary cylinder 15. Rotary cylinder 15 is articulated on one side with bearing 11 and is connected on the other side by a gusset plate to bar 8. When appropriately actuated, rotary cylinder 15 provides rotary motion in either a clockwise or counterclockwise direction about its articulated bearing 11.

Operation of rotary cylinder 15 serves to move swivel arm 7 between two positions such that in a first depressed or intermediate position A, shown in broken lines in FIG. 1, the swivel arm is generally horizontal relative to platform 1 of the demolition machine and in a raised position B, which is reached by action of the rotary cylinder 15, the parallel bars 8 and 9 are substantially parallel to moveable shield 3, that is, substantially vertical.

Figure 2:
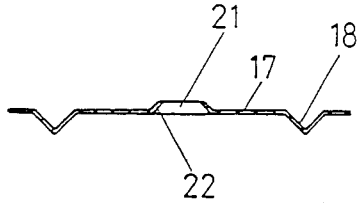
FIG. 2 is an elevational view in cross-section of a support plate for use in rock bolting according to the present invention.

Shoe 14, which receives the roof support plate 17, is provided with slanted locating surfaces 16 that are inclined inwardly relative to the outside of shoe 14 for receiving corresponding surfaces 18 on support plate 17. FIG. 2 is a side elevational view in cross section of support plate 17, and it is seen that reinforcement or structural ridges are provided in the support plate to increase the stiffness thereof. More specifically, the structural stiffening or reinforcement grooves 18 are formed as two V-shaped grooves that extend over the length of support plate 17.

Accordingly, shoe 14 has two inclined contact surfaces 16 that serve to center support plate 17 in the transverse direction, so that the two V-shaped reinforcement grooves 18 in support plate 17 lie adjacent contact or location surfaces 16 of shoe 14. At least one of the two shoes 14 is provided with a centering rod 19 that centers the support plate in the longitudinal direction by engaging a centering hole 20 that is formed in support plate 17.

As further shown in FIG. 2, support plate 17 also has several through holes 21 distributed along its length, each support hole 21 being formed having an indented conical countersink 22 that acts to center a drill rod or an anchor bolt or a tube for introducing synthetic resin into the bore hole drilled in the roof.

The operation of the apparatus according to the present invention may be seen from the three different positions, A, B, and C, in FIG. 1. More specifically, the demolition machine upon which the inventive apparatus is mounted is advanced in steps. Before such advance is taken, moveable shield 3 is lowered to a lowermost position, as represented at C in FIG. 1, by retracting lifting pistons 4. At the time the moveable shield 3 is moved downwardly through action of lifting piston 4, swivel arms 7 will be rotated counterclockwise from a vertical position B to a horizontal position, as in positions A and C. When swivel arm 7 is in the horizontal orientation at position C, shoe 14 is facing upwardly and a new support plate 17 can be conveniently placed thereon at a place in the tunnel or excavation where a support plate has already been anchored to the roof. When support plate 17 is placed on shoes 14 it is automatically centered transversely by action of the inclined surfaces 16 and centered longitudinally by action of the centering rod 19. At that point, the demolition machine advances a step and then the moveable shield 3 is raised by means of lifting pistons 4 to approximately position A. At such point, a scanner 23 which is attached to the upper edge of a moveable shield 3 determines the distance from the upper edge of moveable shield 3 to the overhang or roof 24 is sufficient to permit upward movement of swivel arms 7. Once it is determined that the distance is sufficient, swivel arms 7 having support plate 17 will be swung upwardly in a clockwise direction by operation of rotary cylinders 15. At such time, support plate 17 mounted on shoes 14 is rotated by means of the parallel bar arrangement 8 and 9 so that support plate 17 is parallel to roof 24 and is pressed against the roof or ceiling of the excavation by forces derived from lifting pistons 4.

Accordingly, it is seen that use of the inventive apparatus permits safe, rapid, simple, and exact positioning of support plates for use in roof bolting. Not only is the safety improved because each support plate is positioned only after the previous support plate has been rock bolted to the roof, but the demolition rate or excavation rate can be increased by providing automatic anchor placement that is made possible by the precise positioning of the support plate by use of the apparatus of the present invention. In addition, the apparatus provided by the present invention takes up little space in the demolition machine, and it is possible to employ the lifting and support plate positioning apparatus in conjunction with the anchor drilling units without impairing the lifting ability as described hereinabove.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. Apparatus mounted on a demolition machine for positioning a support plate against a roof in underground construction, comprising:

a moveable carrier mounted on the demolition machine;

two swivel arms mounted on said moveable carrier for rotation between a horizontal position and a vertical position, a shaft, each said swivel arm including a pressure shoe at a free end thereof, each of said pressure shoes further including a first centering means for centering the support plate transversely to a longitudinal extension of said support plate, and at least one of said two pressure shoes further including a second centering means for centering a support plate in a longitudinal direction thereof; and means for mounting said shoes to said arms so that said shoes are pivoted toward said roof at the vertical position of the arms, thereby to press a support plate against the roof of the underground construction.

2. Apparatus according to claim 1, further comprising a lifting piston affixed to said demolition machine and said moveable carrier for moving said moveable carrier and said swivel arms in an upward direction toward the roof.

3. Apparatus according to claim 1, in which each of said swivel arms includes two parallel bars mounted for articulation on said carrier, wherein said two parallel bars, said pressure shoe, and said carrier form a parallelogram bar structure.

4. Apparatus according to claim 1, wherein said second centering means includes a rod engaging a corresponding centering hole formed in a support plate.

5. Apparatus according to claim 3, in which said moveable carrier and said two arms are affixed to a moveable shield that is moveable in an upward direction toward the roof.

6. Apparatus according to claim 5, further comprising a scanning means for scanning the roof of the underground construction to detect a predetermined clearance therefrom, said scanning means being affixed to an upper edge of said moveable shield.

7. Apparatus according to claim 6, in which said second centering means includes a rod that engages a corresponding centering hole formed in a support plate.

8. A system for the use with an excavation machine for supporting a roof in an underground construction, comprising:

a moveable carrier mounted on the excavation machine;

a support plate for placement against the roof of the underground construction;

two swivel arms mounted on said moveable carrier for rotation between a vertical position and a horizontal position, each said arm including a pressure shoe at a free end thereof, each of said pressure shoes including a first centering means for centering said support plate transversely to a longitudinal extension thereof, and at least one of said pressure shoes further including a second centering means for centering said support plate in a longitudinal direction thereof; and means for mounting said shoes to said arms so that said shoes are pivoted to face the roof at the vertical position of said arms, thereby to press said support plate against the roof of the underground construction.

9. A system according to claim 8, in which said support plate includes a plurality of through holes distributed over said longitudinal extension thereof, said through holes having a conical countersink for receiving a respective anchor bar.

10. A system according to claim 8, further comprising a lifting piston affixed to said excavation machine and said moveable carrier for moving said moveable carrier and said swivel arms in an upward direction toward the roof.

11. A system according to claim 8, in which each of said swivel arms includes two parallel bars mounted for articulation on said carrier, wherein said two parallel bars, said pressure shoe, and said carrier form a parallelogram bar structure.

12. A system according to claim 8, wherein said second centering means includes a rod engaging a corresponding centering hole formed in said support plate.

13. A system according to claim 12, in which said centering hole is formed having a conical countersink.

14. A system according to claim 11, in which said moveable carrier and said two arms are affixed to a moveable shield that is moveable in an upward direction toward the roof.

15. A system according to claim 14, further comprising a scanning means for scanning the roof of the underground construction to detect a predetermined clearance therefrom, said scanning means being affixed to an upper edge of said moveable shield.

16. A system according to claim 15, in which said second centering means includes a rod that engages a corresponding centering hole formed in said support plate.

* * * * *